United States Patent [19]

Cain et al.

[11] Patent Number: 4,696,210

[45] Date of Patent: Sep. 29, 1987

[54] TWO HOLE AUTOMATIC PRECISION PUNCH

[75] Inventors: Charles E. Cain, Tipp City; Gary L. Cain, New Carlisle, both of Ohio

[73] Assignee: Chief Technology Systems, Inc., New Carlisle, Ohio

[21] Appl. No.: 879,895

[22] Filed: Jun. 30, 1986

[51] Int. Cl.[4] ..... B21D 28/04; B26F 1/38

[52] U.S. Cl. ..... 83/33; 83/50; 83/215; 83/368; 83/451; 83/560

[58] Field of Search ..... 83/33, 215–217, 83/365, 368, 360, 451, 560, 50

[56] References Cited

U.S. PATENT DOCUMENTS

| | | | |
|---|---|---|---|
| 3,197,353 | 7/1965 | Williams et al. | 83/365 X |
| 3,293,439 | 12/1966 | Marantette | 83/365 X |
| 4,349,997 | 9/1982 | Hayasaka et al. | 83/368 X |
| 4,541,317 | 9/1985 | VanHumbeeck et al. | 83/217 X |

*Primary Examiner*—Frank T. Yost

*Attorney, Agent, or Firm*—Becker & Becker

[57] ABSTRACT

An apparatus for producing registration holes in a sheet-like workpiece that is provided with registration marks. The apparatus comprises: a frame; sheet holding means associated with the frame for holding a workpiece in place; a main carriage associated with the frame, with one of the main carriage and the sheet holding means, and hence a workpiece, being movable back and forth in a first direction relative to the other; a cross carriage mounted in the main carriage, with one of the cross carriage and the sheet holding means being movable back and forth in a second direction relative to the other, with the second direction being at right angles to the first direction; a further carriage mounted on the cross carriage, with one of the further carriage and the sheet holding means being movable relative to the other substantially in the first direction; first sensor means for sensing the position of the main carriage relative to a given one of the registration marks on the workpiece; second sensor means for sensing the position of the cross carriage relative to the same given registration mark on the workpiece; third sensor means for sensig the position of the further carriage relative to another one of the registration marks on the workpiece; a first punch assembly that is secured to the cross carriage and is provided with a first punch to punch out said given one of the registration marks to produce a registration hole in the workpiece; and a second punch assembly that is secured to the further carriage and is provided with a second punch to punch out said another one of the registration marks to produce another registration hole in the workpiece.

8 Claims, 6 Drawing Figures

TWO HOLE AUTOMATIC PRECISION PUNCH

BACKGROUND OF THE INVENTION

The present invention relates to equipment of the type used in the manufacture of instrument panels and nameplates, and, more particularly, to a machine for such an application which automatically locates and punches registration holes in a sheet printed with multiple like patterns; these registration holes are then used in conjunction with a feed-bar to locate or register a pattern punch and die to each pattern to form and punch out individual panels.

Previously, a sheet was printed with like patterns aligned in strips and precisionly sheered along one side and on each end. A pattern punch and die was fitted with a "Button Strip" which had notches on each end and a back-stop used for registration of each pattern under the punch. The operator would slide the strip with the printed pattern under the punch and push it against the side edge stop and against the notch at the end. The punch would be activated to form and punch out the panel. Next the operator would lift the strip with the patterns and slide in one position to the right and into the next notch cut into the button strip at the proper location, the punch is again activated and the second panel is formed and punched. This process continues until the center of the strip is reached. When the center is reached the operator uses notches located on the left side of the button strip. Again the punch is activated and the pattern is formed and punched. The strip is moved to the right but registers to a notch on the left side. This process continues until all of the panels are formed and punched.

This method, although used successfully for many years, has certain limitations such as positioning errors due to operator error. On a sheet with many patterns, it is difficult to consistently and accurately position the pattern strip on the button strip stops. Also, since the shearing of the sheet provides the reference edges, this must be done with great accuracy which can be obtained only with an expensive automatic sheer designed specifically for precision sheering.

It is thus obvious that there is a need to eliminate the operator error by providing a means to precisely locate the pattern under the pattern punch and die with a non precision movement by the operator, and to eliminate the requirement to precisely shear three edges of each strip. consists of a narrow flat bar with two precisionly located pins, one on each end, and V-notches located along the length of the bar to locate each pattern. The V-notch sits on a pin that is located in the die assembly. The sheet with the like patterns aligned in strips needs two registration holes punched at each end of each strip in predetermined locations to match those on the feed bar. The sheet is then coarsely sheared into strips. A strip is placed on the pins of the feed bar, with a pattern being located over the first notch. As the feed bar notch drops onto the registration pin it self aligns due to its V shape. This eliminates the need for the operator to critically align the pattern under the pattern punch and die. The punch is then activated and the pattern is formed and punched. The feed bar is lifted, slid to the right, and the next V-notch of the feed bar is dropped on the registration pin, where it again self aligns awaiting to be formed and punched. This process continues until each pattern has been formed and punched. The punched strip is removed and an unpunched strip is placed onto the feed bar, whereupon the above process is repeated.

Accordingly, it is seen that the only precision operation in this process is the punching of the two registration holes used by the feed bar. Thus, a need exists for a means to punch these registration holes without operator influence.

It is therefore an object of the present invention to provide an apparatus and method for precisely punching out registration holes in a sheet of patterns so that the latter can then be formed with a mechanism that utilizes the registration holes to precisely locate the pattern.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The inventive apparatus for producing registration holes in a sheet-like workpiece that is provided with registration marks comprises: a frame; sheet holding means associated with the frame for holding a workpiece in place; a main carriage associated with the frame, with one of the main carriage and the sheet holding means, and hence a workpiece, being movable back and forth in a first direction relative to the other; a cross carriage mounted in the main carriage, with one of the cross carriage and the sheet holding means being movable back and forth in a second direction relative to the other, with the second direction being at right angles to the first direction; a further carriage mounted on the cross carriage, with one of the further carriage and the sheet holding means being movable relative to the other substantially in the first direction; first sensor means for sensing the position of the main carriage relative to a given one of the registration marks on the workpiece; second sensor means for sensing the position of the cross carriage relative to the same given registration mark on the workpiece; third sensor means for sensing the position of the further carriage relative to another one of the registration marks on the workpiece; a first punch assembly that is secured to the cross carriage and is provided with a first punch to punch out said given one of the registration marks to produce a registration hole in the workpiece; and a second punch assembly that is secured to the further carriage and is provided with a second punch to punch out said another one of the registration marks to produce another registration hole in the workpiece.

In a preferred embodiment of the inventive apparatus, the sheet holding means is securely mounted in the frame, the main carriage is movably mounted in the frame in such a way as to be movable back and forth in the first direction relative to the sheet holding means and hence to a workpiece thereon, the cross carriage is movable mounted in the main carriage in such a way as to be movable back and forth in the second direction relative to the workpiece, and the further carriage is movably mounted on the cross carriage in such a way as to be movable back and forth in the first direction relative to the workpiece.

The present invention also provides a novel method for producing registration holes in a workpiece. In particular, by providing three carriages that are movable relative to the workpiece, the punch assemblies can be aligned precisely with registration marks on the workpiece.

Further specific features of the present invention will be described in detail subsequently.

DETAILED DESCRIPTION OF PREFERRED EMBODIMENTS

Figure 4:
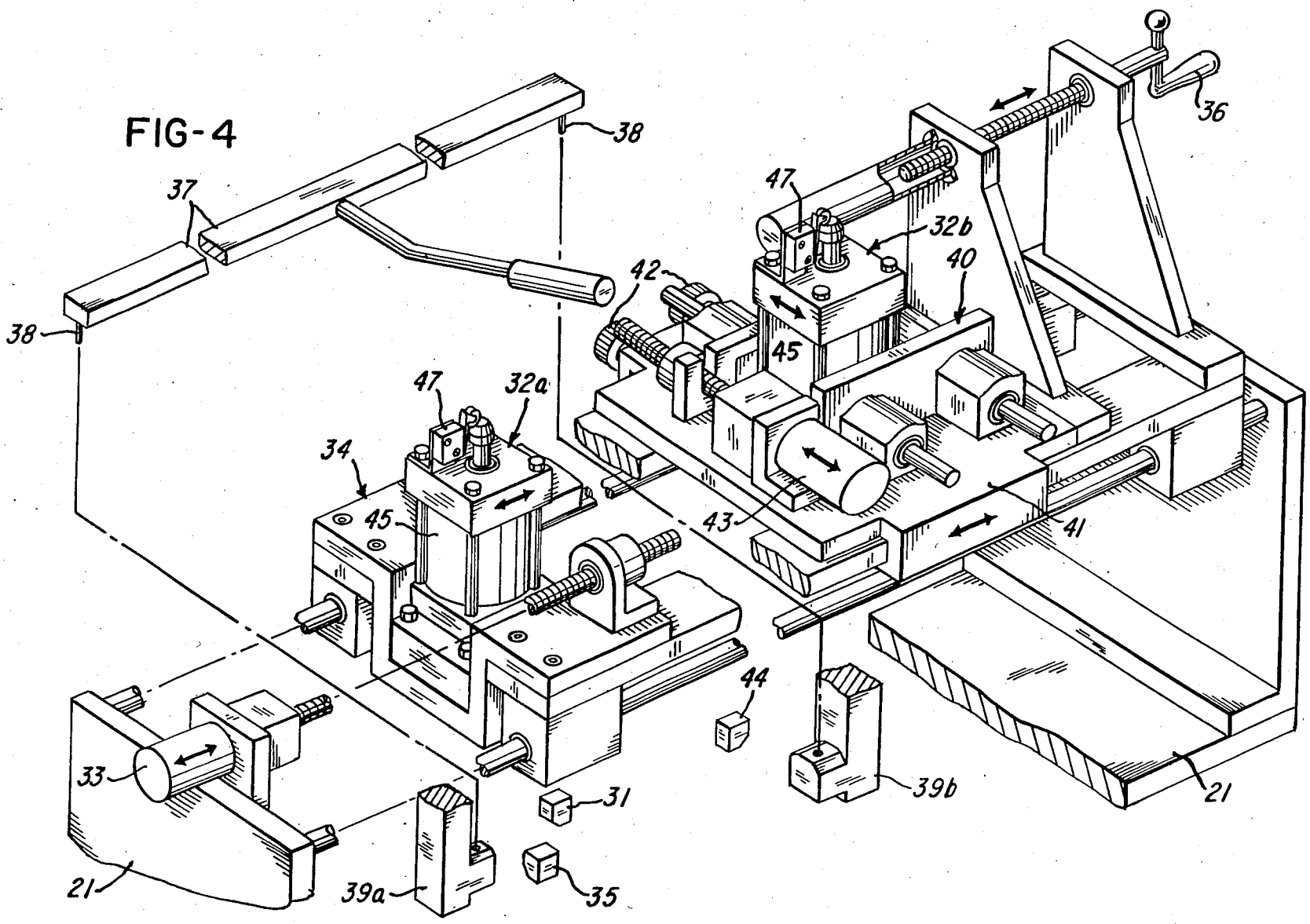
FIG. 4 is an enlarged view of the carriage assemblies, and also shows the set-up bar.
Figure 5:
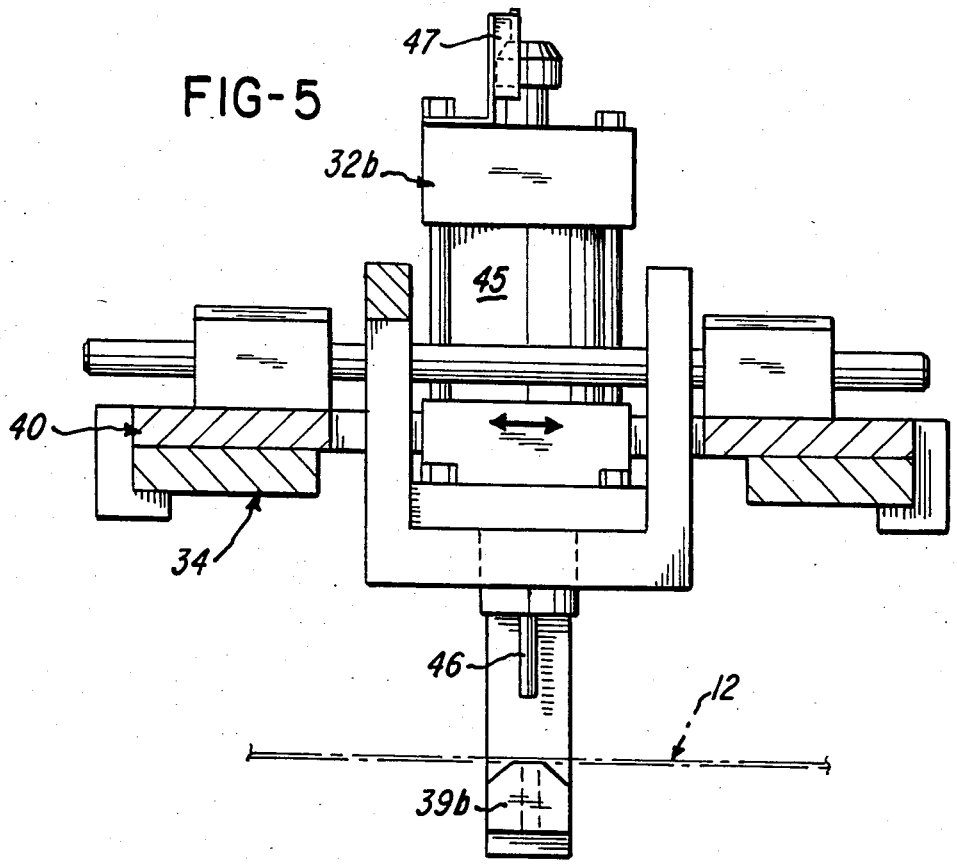
FIG. 5 is a cross-sectional view taken along line 5—5 in FIG. 3.
Figure 6:
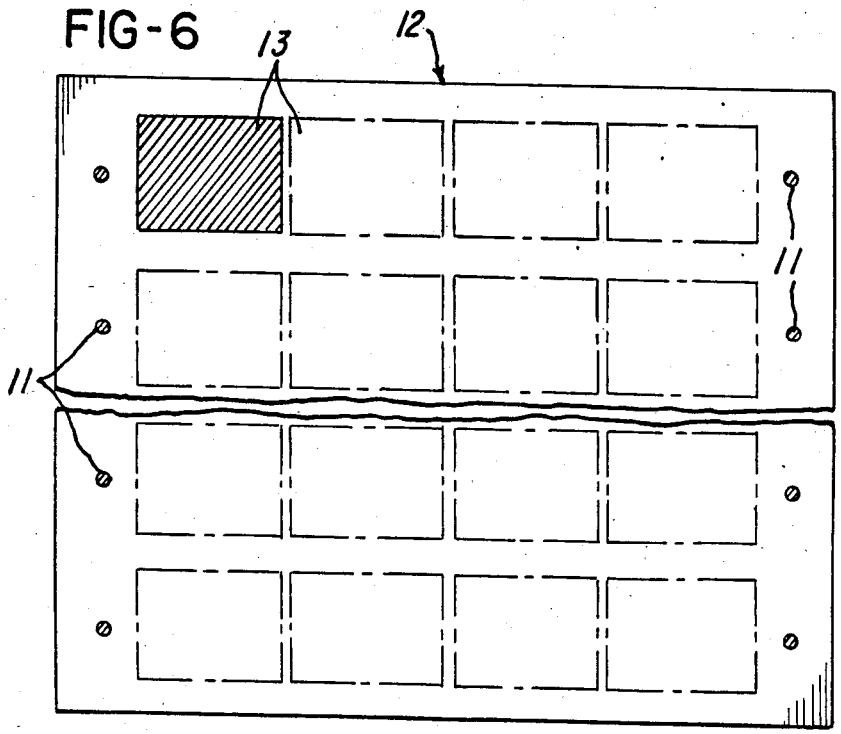
FIG. 6 illustrates a typical workpiece sheet.

FIGS. 1–5 illustrate a machine, constructed according to the present invention, for punching reference holes in a work sheet such as the one illustrated in FIG. 6.

The present invention is directed to a machine which automatically senses and servos two punch assemblies into alignment with two registration marks 11 on a sheet, and then punches two registration holes. These holes may, for example, be three-sixteenths inch in diameter. FIG. 6 depicts a typical sheet 12 showing the series of like patterns 13 that are aligned in strips, with the registration marks 11 being provided at each end of a strip. In the area of the registration marks there is a margin free of pattern printing. This area may be printed with a solid color, except for the registration marks, or left as bare metal.

The sheet 12 is placed on the machine against the head guide 20 (FIGS. 1 and 3) for proper location under the main carriage 21. When a start button, e.g. on the control box 23, is depressed, a valve is activated which allows a vacuum (the vacuum pump is not illustrated) to be pulled through the table 25 to hold the sheet 12 in place (FIG. 2) thereon; this table is stationary. The main servo motor 26 is energized and starts to turn the flexible coupling 27, thus turning the main lead screw 28. A main screw drive nut 30 (FIG. 2) is attached to the carriage 21 and moves the latter forward as the lead screw 28 starts to turn. The motor 26 accelerates the carriage 21 to the run velocity until the main sensor means 31 (FIGS. 2 and 4) locates the first left registration mark 11. The carriage 21 then decelerates and servos front to back to align the left punch assembly **32*a* over the left registration mark 11**.

Figure 3:
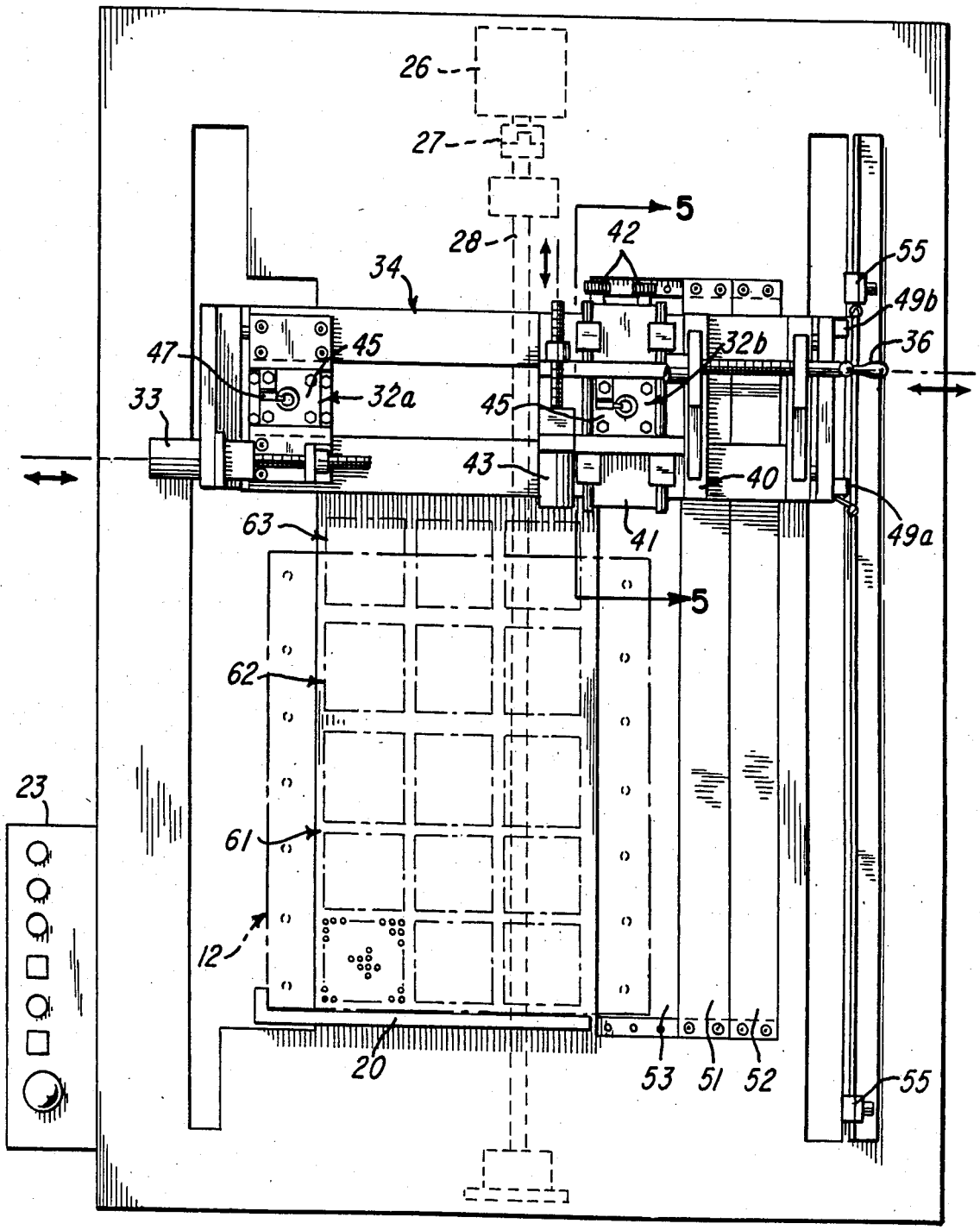
FIG. 3 is a plan view of the apparatus of FIG. 1, with the cover of the main carriage removed, and with some of the details being omitted.

Once the main carriage 21 is aligned front to back, the servo motor 33 of the cross carriage 34, which is movable mounted on the main carriage (FIGS. 2 and 4), is activated to align the left punch assembly **32*a* and the right punch assembly 32*b* over the left and right registration marks 11 with a left or right servo action, using the cross sensor 35 (FIGS. 2 and 4) to view the left registration mark. The distance between the left and right punch assemblies 32*a*, 32*b* is fixed to a predetermined length (which corresponds to the distance between the left and right registration marks 11 at opposite end of a strip of patterns 13 on a sheet 12) during job set up by utilizing the set up crank 36 and the set up bar 37 (FIG. 4). The set up bar 37 has two precisionly located pins 38 which drop into the left punch anvil 39*a* and the right punch anvil 39*b* as the set up crank 36 is rotated. Rotating the set up crank 36 moves the right punch carriage 40, and hence the right punch assembly 32*b*, in a left to right manner until the proper distance measured using the set up bar 37 is set. The base 41 of the right punch carriage 40 is then locked in place on the cross carriage 34 with two locking knobs 42 shown in FIGS. 3 and 4**.

Figure 2:
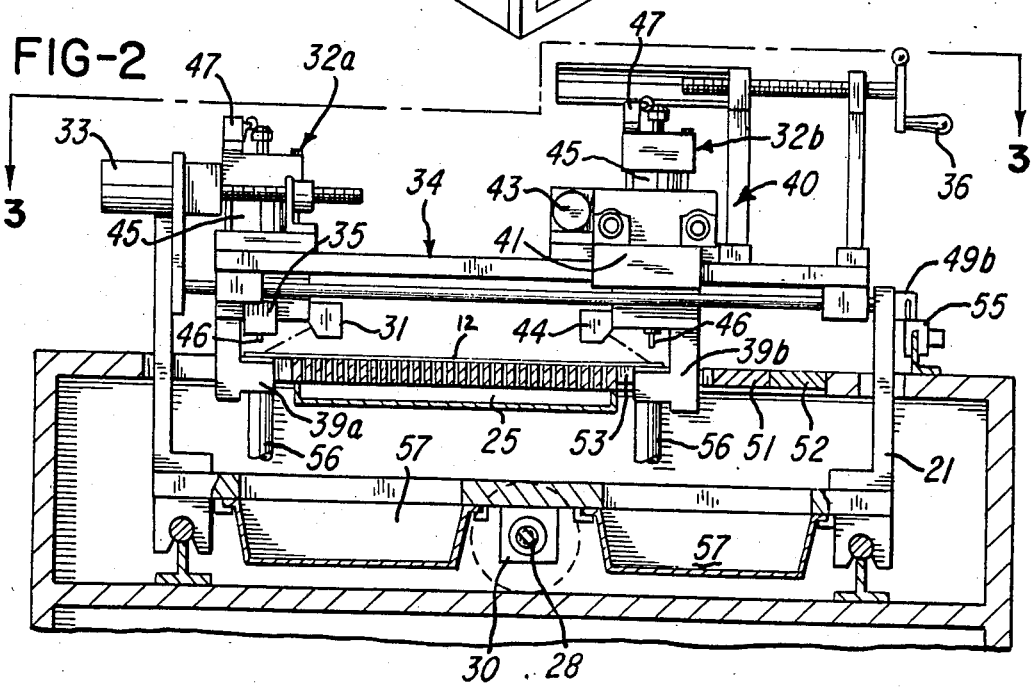
FIG. 2 is a cross-sectional view taken along the line 2—2 in FIG. 1.

After left to right alignment is achieved, the right punch carriage servo motor 43 is activated and servos with a front to back movement until the right punch assembly **32*b* is aligned with the right registration mark 11 as detected by the right sensor 44 of FIGS. 2 and 4**.

When the two punch assemblies **32*a*, 32*b* are correctly aligned, the servo motors 26, 33, 43 are deactivated and a valve is energized which directs air pressure to the top of the left and right punch cylinders 45 (FIG. 4). The air forces the cylinder rods, with the punches 46 attached, to move downwards through the sheet 12 and into the anvils 39*a*, 39*b*, thus punching the reference holes (FIGS. 2, 5). After an enlarged time adequate for punch completion, perhaps one second, the valve is deenergized and air is directed to the bottom of the two cylinders 45 to push the punches 46 to the up position. Means preferably in the form of resilient elastomeric material, or other spring-like means, are used to help keep the punched sheet 12 in place so that it will not be raised up off the table 25 as the punches 46 are raised. When an elapsed time is up, perhaps one second, and the punch limit switches 47 are activated, indicating the punches 46 are up and it is safe to move, the main servo motor 26 is again activated and the main carriage 21 moves forward until the next left registration mark 11 is located. When the next mark is located, the process described above will be repeated, and the second set of registration holes will be punched. This process continues until the main carriage 21 trips a front stop limit switch 49*a*. If a sheet 12 was punched upon completion of the forward motion, a totalizing counter will be incremented by one. The main carriage motor will decelerate, then reverse, and accelerate to the run velocity until a back stop limit switch 49*b* is activated. The main motor 26** will then decelerate and stop until the start button is again activated.

Figure 1:
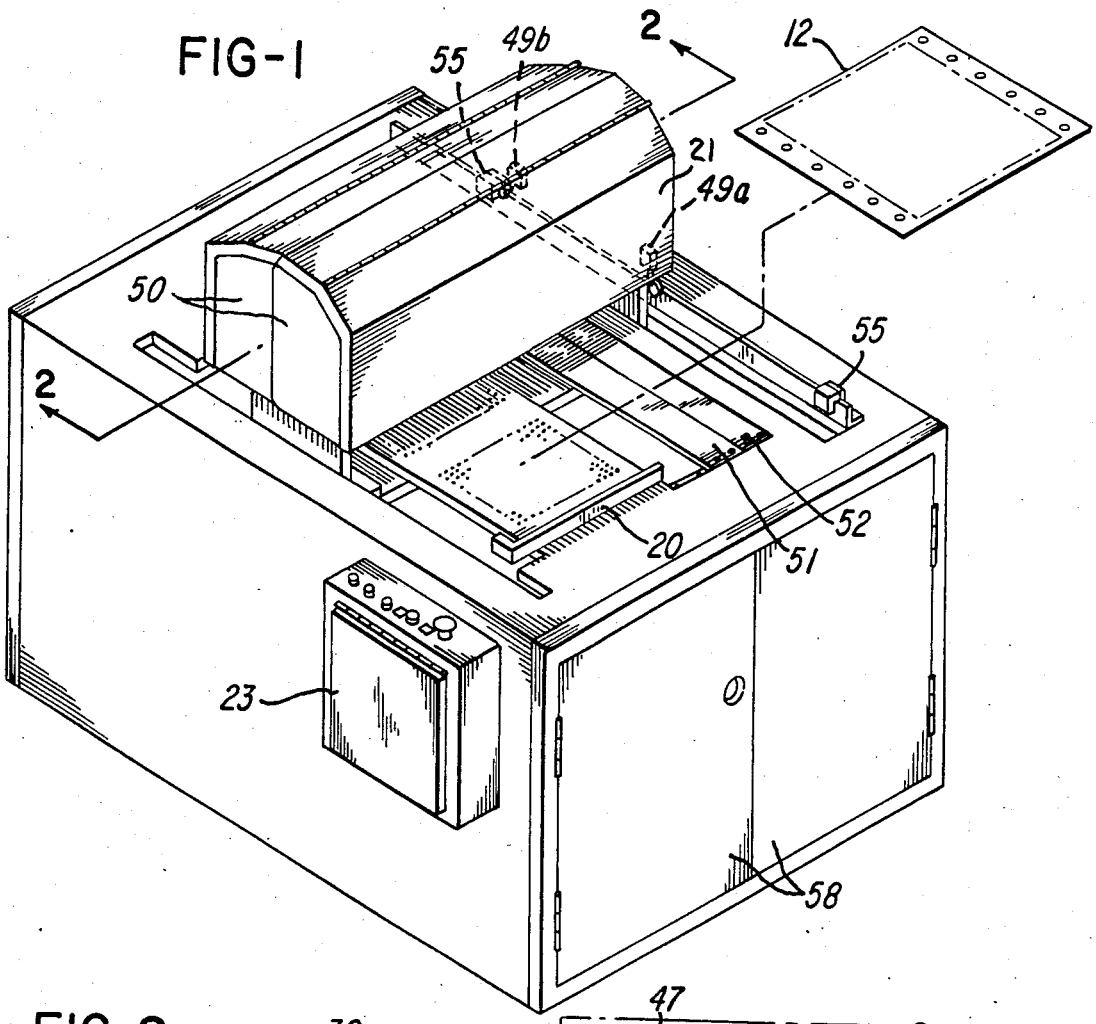
FIG. 1 is a perspective view of the inventive apparatus showing the main carriage, a control box, and location of the workpiece sheet.

Access to the carriage assembly 21, 34, 40 is achieved by raising the two sheet metal doors 50 (FIG. 1). This access is required to set punch to punch spacing, and front and back limit switch positions. There are many possible widths to which the punch to punch spacing may be set. FIGS. 1 and 3 show two plates, plate one (51) and plate two (52), and a right open space 53 for anvil clearance. If set up requires wider spacing, plate one (51) can be removed and the right punch assembly **32*b* can be adjusted out, with plate one (51) then being placed in the previously open area 53. Likewise, if still further explanation is required, plate two (52) can be removed and the right punch assembly 32*b* can again be adjusted out, with plate two (52) being placed in the previously open area next to plate one (51)**.

The front and back stop limit switches **49*a*, 49*b* are used to limit motion of the main carriage 21 to optimize speed on sheets 12 where large patterns 13 result in only a few holes to be punched. A lever is rotated 180 degrees to release one or both of the stops 55, the stop or stops are moved to the desired positions, and the lever is returned to the locked position. The limit switches 49*a*, 49*b* are expediently located on the main carriage 21** itself.

As sheets 12 are punched, the slugs are directed out of the bottom of the anvils 39*a*, 39*b*, through the two hoses 56, and into two collection pans 57 (FIG. 2). Access to these pans 57 is achieved by opening the two front doors 58 shown in FIG. 1.

FIGS. 2–5 show that all of the carriages 21, 34, 40 are mounted on precision-ground shaft guide rods with linear bearings for accurate, smooth operation.

To accommodate all lengths of work sheets, the vacuum table 25 is divided into three sections. FIG. 3 shows sections one (61), two (62) and three (63). Section one is always used to hold sheets. If a longer sheet is desired, a manual valve is opened, with access being through the front doors 58. Now when vacuum is required, both section one and two are used. If a still longer sheet is desired, then another valve, also accessed through the front doors, is opened. When vacuum is required with both valves opened, sections one, two and three all will be pulling a vacuum.

Located on the control box 23 are status indicators, push botton matrix, calibration setpoint controls, specular or diffuse lighting selection switch, totalizing counter, emergency power off switch, start push buttom, power on push button, and the power key switch. The matrix of push buttons is used to manually move all of the carriages in a given direction, to send the main carriage 21 to the home position, to put the punch activation in auto or manual, to manually activate the punches, to reset the electronics to restart status, to turn off the alarm, and to manually activate the vacuum.

The status indicators shown when the main carriage alignment is achieved, the cross alignment is achieved, the right carriage alignment is achieved, ready to punch, seeking home, auto/manual, vacuum on, punch enabled, and right or left punch is down in a fault condition.

To calibrate the alignment of the punches to the registration marks 11, three calibration setpoint controls are provided. These controls are adjusted to achieve the desired results when the holes are punched. The main control will alter the left punch position, front to back, over the left reference mark. The cross control will alter both punch positions, right to left over the reference marks, and the right control alters the right punch position, front to back, over the right reference mark.

Depending on the contrast between the reference marks 11 and the background, a selection of diffuse or specular lighting is made. In general, if the reference mark is an inked mark on an inked background, diffuse lighting is used; if a bare metal mark or bare metal background is used, specular lighting is used. These lights are located in the vicinity of the sensors 31, 35, 44, and selection is made by positioning the specular-diffuse switch to the appropriate position.

Although in the illustrated preferred embodiment, the means for holding the patterned sheet 12 that is to be punched in place on the machine during the entire process is shown as the vacuum table 25, other means, such as mechanical means, could also be used.

It should also be noted that whereas the sheet 12 has been described as being fixed in place on the stationary vacuum table 25, with the main carriage 21 being movable, the situation could also be reversed, with the table 25, and hence the sheet 12, being movable relative to a fixed main carriage 21. The principle is still the same.

The present invention is, of course, in no way restricted to the specific disclosure of the specification and drawings, but also encompasses any modifications within the scope of the appended claims.

What we claim is:

1. An apparatus for producing registration holes in a sheet-like workpiece that is provided with registration marks, said apparatus comprising:

a frame;

sheet holding means associated with said frame for holding a workpiece in place;

a main carriage associated with said frame, with one of said main carriage and said sheet holding means, and hence a workpiece, being movable back and forth in a first direction relative to the other;

a cross carriage mounted in said main carriage, with one of said cross carriage and said sheet holding means being movable back and forth in a second direction relative to the other, with said direction being at right angles to said first direction;

a further carriage mounted on said cross carriage, with one of said further carriage and said sheet holding means being movable relative to the other substantially in said first direction;

first sensor means for sensing the position of said main carriage relative to a given one of said registration marks on said workpiece;

second sensor means for sensing the position of said cross carriage relative to said same given registration mark on said workpiece;

third sensor means for sensing the position of said further carriage relative to another one of said registration marks on said workpiece;

a first punch assembly that is secured to said cross carriage and is provided with a first punch to punch out said given one of said registration marks to produce a registration hole in said workpiece; and a second punch assembly that is secured to said further carriage and is provided with a second punch to punch out said another one of said registration marks to produce another registration hole in said workpiece.

2. An apparatus according to claim 1, in which said sheet holding means is securely mounted in said frame; in which said main carriage is movably mounted in said frame in such a way as to be movable back and forth in said first direction relative to said sheet holding means and hence to a workpiece thereon; in which said cross carriage is movably mounted in said main carriage in such a way as to be movable back and forth in said second direction relative to said workpiece; and in which said further carriage is movably mounted on said cross carriage in such a way as to be movable back and forth in said first direction relative to said workpiece.

3. An apparatus according to claim 2, in which said sheet holding means is in the form of a vacuum table; and which includes means for providing a vacuum to effect holding of a workpiece on said table.

4. An apparatus according to claim 2, which includes respective anvil means associated with said cross carriages and said further carriage on that side of a workpiece remote from said punch assemblies.

5. An apparatus according to claim 2, in which said first sensor means is disposed on said cross carriage, said second sensor means is also disposed on said cross carriage, and said third sensor means is disposed on said further carriage.

6. An apparatus according to claim 2, which includes stop means on said frame, and limit switch means on said main carriage to signal when said stop means has been reached.

7. An apparatus according to claim 2, in which said further carriage is also movable back and forth on said cross carriage in said second direction; and which includes means for manually effecting said movement of said further carriage relative to said cross carriage in said second direction to set the distance between said first and second punch assemblies.

8. A method of producing registration holes in a sheet-like workpiece that is provided with registration marks, said method including the steps of:

providing a workpiece with registration marks;

moving one of a first carriage and said workpiece relative to the other in a first direction until a first sensor means senses the position of said first carriage relative to a given one of said registration marks on said workpiece;

moving one of a second carriage and said workpiece relative to the other in a second direction, at right angles to said first direction, until a second sensor means senses the position of said second carriage relative to said same given registration mark on said workpiece;

moving one of a third carriage and said workpiece relative to the other substantially in said first direction until a third sensor means senses the position of said third carriage to another one of said registration marks on said workpiece;

punching out said given one of said registration marks to produce a registration hole in said workpiece; and punching out said another one of said registration marks to produce another registration hole in said workpiece.

* * * * *